US006247405B1

(12) United States Patent
Hanke et al.

(10) Patent No.: US 6,247,405 B1
(45) Date of Patent: Jun. 19, 2001

(54) WASHING DEVICE FOR CYLINDERS OF ROTARY PRINTING PRESSES

(75) Inventors: Bernd Hanke, Dresden; Gunnar Tschacher, Radebeul, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/629,196

(22) Filed: Jul. 31, 2000

(30) Foreign Application Priority Data

Jul. 29, 1999 (DE) ..... 199 35 699

(51) Int. Cl.[7] ..... B41F 35/00
(52) U.S. Cl. ..... 101/424; 101/425
(58) Field of Search ..... 101/424, 425, 101/423; 15/256.51, 256.52

(56) References Cited

U.S. PATENT DOCUMENTS 3,827,699 * 8/1974 Waugh ..... 274/47
5,012,739 * 5/1991 Loos et al. ..... 101/425
5,440,986 * 8/1995 Braun ..... 101/425
6,089,768 * 7/2000 Barrus et al. ..... 400/239

FOREIGN PATENT DOCUMENTS

3841269 A1 12/1988 (DE) .
43 06 676 A1 3/1993 (DE) .
43 19 258 A1 6/1993 (DE) .
195 43 518 A1 11/1995 (DE) .

* cited by examiner

*Primary Examiner*—John S. Hilten
*Assistant Examiner*—Anthony Nguyen
(74) *Attorney, Agent, or Firm*—Jones, Tullar & Cooper, P.C.

(57) ABSTRACT

A washing device for cylinders of rotary printing presses includes a cleaning cloth, which can be brought into contact with the surface of the cylinder by a pressure element which can be placed against the cylinder to be cleaned. Unused cleaning cloth is stored in the form of a supply roll located on a first spindle, and the used cleaning cloth is allocated to a second spindle as a receiving roll. A is arranged either on the first spindle or on the second spindle and which is connected via a releasable connection, to the beginning of the clean cleaning cloth.

5 Claims, 2 Drawing Sheets

WASHING DEVICE FOR CYLINDERS OF ROTARY PRINTING PRESSES

FIELD OF THE INVENTION

The present invention relates to a washing device for cylinders of rotary printing presses. The washing device consists of a cleaning cloth, which can be brought into contact with the surface of the cylinder by means of a pressure element. The unused cleaning cloth is stored in the form of a supply roll located on a first spindle, and the used cleaning cloth is allocated to a second spindle as a receiving roll.

BACKGROUND OF THE INVENTION

For replacing the used-up cleaning cloth in a cylinder washing device, it is customary to remove the empty spindle of the supply roll from the cleaning device, to wind fresh cleaning cloth on it and to put it back. The full receiving roll is removed, the soiled cleaning cloth is unwound from it, the empty spindle is again placed into the cleaning device and the beginning of the cleaning cloth is fixed in place on the latter.

There have been no lack of attempts to make this method more user-friendly A solution is known from DE 38 41 269 A1, wherein the soiled cleaning, cloth is wound back on the supply roller, so that here the supply roller can be replaced by a fresh one.

In the solution known from DE 43 19 258 A1, rewinding is avoided. In this case,the cleaning device is designed in such a way that it can rotated around its longitudinal axis by approximately 180° C. The positions of both rolls can then be exchanged after the cleaning cloth has been wound off the supply roll. After this, the empty supply roll is used for winding up the soiled cleaning cloth, i.e. as receiving roll. The full receiving roll with the soiled cleaning cloth can then be removed and provides space for a fresh supply cloth.

A further solution for simplifying the changing of the cleaning cloth is known from DE 195 43 518 A1. The design of that device is such that the cleaning cloth of both rolls is wound on tubes, which in turn are seated on shafts seated laterally in the machine frame. Because of this, it is possible to remove the rollers from the machine transversely and parallel with the cylinder axis and in this way to replace the empty roller with a fresh one.

The limitations of the above mentioned solutions consist in that, in spite of the simplification of the change of the rollers, the insertion of the fresh cleaning cloth into the washing device and the fixing in place of the beginning of the fresh cleaning cloth on the receiving spindle continue to require skill and patience on the part of the operator.

A solution is described in DE 43 06 676, in which the changing of the cleaning cloth, and in this connection the draw-in of the cleaning cloth into the washing device in particular, are intended to be simplified. A gripper is proposed, which gripper is fastened on a circulating traction means, preferably a toothed belt. The gripper grasps the end of the cleaning cloth and conducts it over the pressure element to the receiving spindle, where it can then be fixed in place. Here, the traction means are manually moved or are driven by a motor.

The limitation of this prior art solution lies in the fact that the device becomes unnecessarily complex, in particular because of the unavoidable traction means together with the gripper, and can only be provided with a great outlay.

OBJECT AND SUMMARY OF THE INVENTION

It is therefore the object of the present invention to develop a simple solution by which the draw-in of the cleaning cloth into the washing device can be simplified.

This object is attained by the provision of a washing device for cylinders of a rotary printing press which uses a cleaning cloth that can be brought into contact with the surface of a cylinder to be cleaned by using a pressure element. Unused cleaning cloth is stored as a supply roll on a first spindle while used cleaning cloth is received on a second spindle as a receiving roll. A flexible draw-in element is arranged on one of the first and second spindles and is connected, by a releasable connection, to the beginning of the unused cleaning cloth.

The advantage of the attainment in accordance with the present invention lies in that it is now possible to draw the beginning of the cleaning cloth into the washing device in a simple manner, without the operator having to reach into the running press.

BRIEF DESCRIPTION OF THE DRAWINGS

The present invention will be explained in greater detail in what follows by means of three preferred embodiments. The drawings connected with this have the following meanings.

DETAILED DESCRIPTION OF THE PREFERRED EMBODIMENTS

Preferred Embodiment 1

Figure 1:
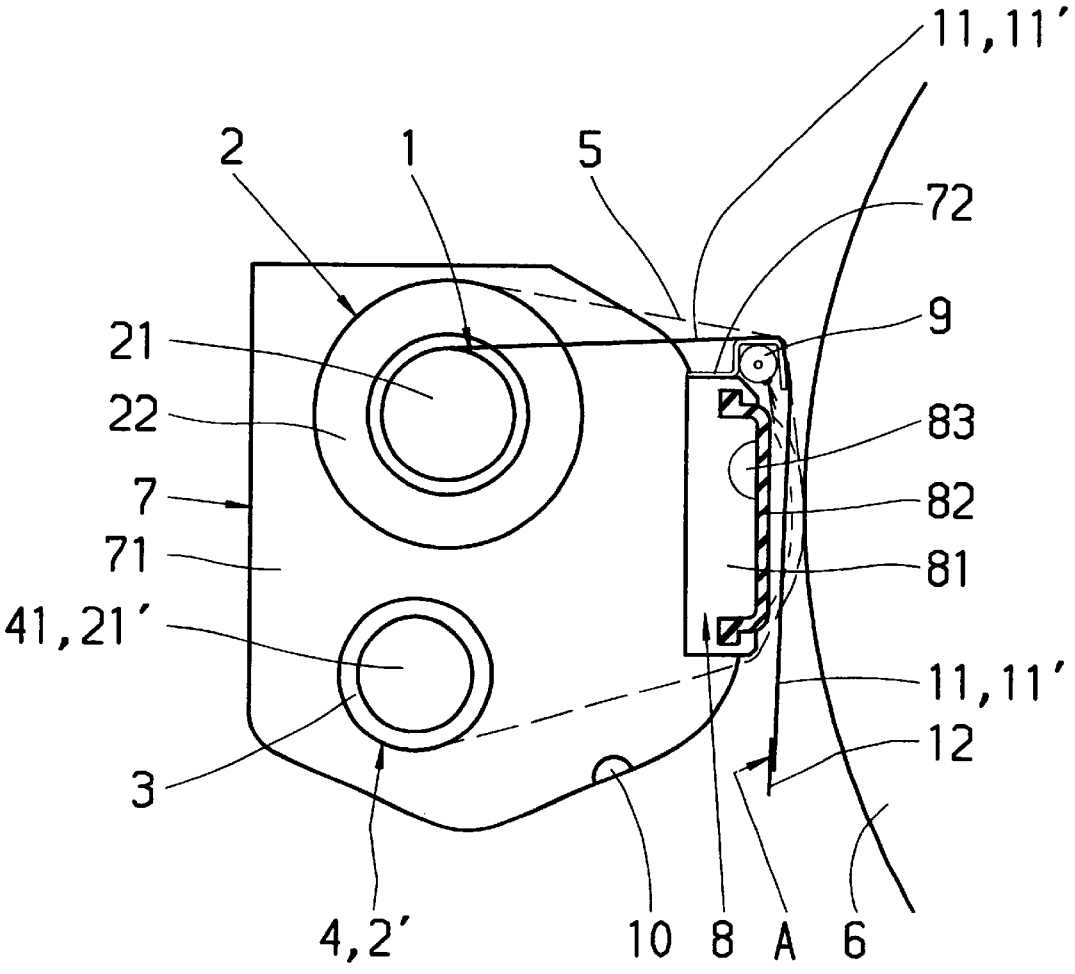
FIG. 1 is a schematic structural representation of a washing device with the draw-in element of the invention at the spindle of the supply roller.

As can be seen in FIG. 1, the cleaning device essentially consists of a first cleaning cloth receptacle 1, a second cleaning cloth receptacle 3, and a cleaning cloth 5, which is pressed against the surface of the cylinder 6 to be cleaned by a pressure element 8.

The first cleaning cloth receptacle 1 is understood to be an installation used for receiving a supply roller 2. Bearing and securing elements, not represented here, are also part of the first cleaning cloth receptacle 1. The supply roller 2 consists of a spindle 21, on which a cleaning cloth supply roll 22 has been wound.

A first situation is represented in FIG. 1 wherein the supply roller 2 is empty. It can be seen that a draw-in element 11 is fastened on the spindle 21. In a second situation, as also seen in FIG. 1 and with the supply roller 2 full, and also during the operation of the washing device, the draw-in element 11 is located, wound up, underneath the supply roll 22. The position of the cleaning cloth 5 in this second situation is indicated by a dashed line in FIG. 1.

The draw-in element 11 has a connecting element 12 on its free end. The connecting element 12 is used for connecting the draw-in element 11 with the cleaning cloth 5 of the supply roll 22, and for this purpose has been designed as a first portion of a two part releasable connection between the draw-in element 11 and the cleaning cloth 5. This two part releasable connection can be provided in the form of a hook and loop connection, by means of mechanical clamps, as an industrial zipper, as a magnetic connection, as an adhesive connection or by other means. It is essential that the counter-element of the two part releasable connection, not specifically represented here, which is arranged on the cleaning cloth 5 can provide the required connection with the connecting element 12 on the draw-in element 11.

The draw-in element 11 consists of a flexible material which can be wound and is made, for example, of a plastic or metal foil, a fabric material, preferably a woven textile material, a fabric-reinforced rubber band, or the like.

The length of the draw-in element 11 is a function of the structural conditions, but it should have such dimension that the operators will have no problems in connecting the draw-in element 11 with the end of the cleaning cloth 5. To this end, it is required that the minimum length is selected such that the end of the draw-in element 11 can be brought into the free, accessible space underneath the pressure element 8. Therefore the length of the draw-in element 11 should be at least 1.5 times the distance between the supply roller and the lower edge of the pressure element 8. The free end of the draw-in element 11 is then temporarily fixed in place in a suitable manner on the frame 7.

Figure 2:
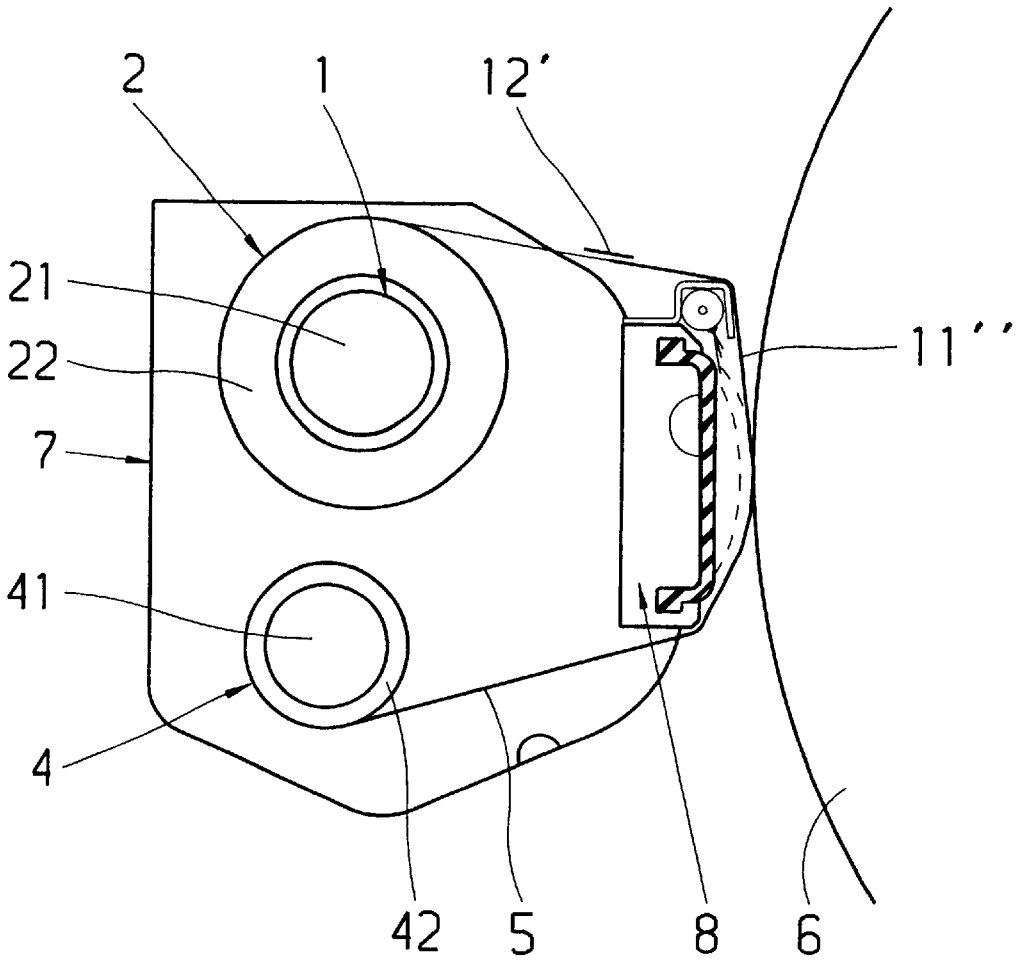
FIG. 2 is a schematic structural representation of a washing device with the draw-in element of the invention at the spindle of the receiving roller.

The second cleaning cloth receptacle 3 is designed analogously to the first cleaning cloth receptacle, but is used for receiving the cleaning cloth 5 pulled off the supply roller 2. The cleaning cloth 5 is wound to form a receiving roll 42 on a spindle 41, as shown in FIG. 2. The spindle 41 and the receiving roll 42 constitute a receiving roller 4.

The first cleaning cloth receptacle 1 is seated in the frame 7, the same as the second cleaning cloth receptacle 3. The spindles 21, 41 are driven by a motor, not represented, as needed, wherein the motor preferably is arranged inside one of the two spindles 21, 41.

The frame 7 consists, inter alia, of frame lateral walls 71, in which, besides the cleaning cloth receptacles 1, 3, a spray tube support 72 is also arranged, on which a spray tube 9 is fastened.

The cleaning cloth 5 is conducted over the side of a pressure element 8 facing the cylinder 6. The pressure element 8 consists of a clamping element 81, in which a rubber diaphragm 82 is tightly clamped, which rubber diaphragm 82 can be charged with compressed air via an air supply 83.

A sensor 10 can be arranged, together with the not represented motor, inside one of the spindles 21, 41, or laterally on the frame 7.

In the course of the cleaning process, the cleaning cloth 5, represented as a dashed line in FIG. 1, is now pulled off the supply roll 22 and is wound on the spindle 41 to form the receiving roll 42. In the process, the cleaning cloth 5 is conducted over a cleaning cloth guide on the spray tube support 72 and over the side of the pressure element 8 which faces the cylinder 6. The advancement of the cleaning cloth 5 can take place in steps. A continuous advancement is also possible.

Compressed air can act on the pressure element 8, so that the rubber diaphragm 82 is displaced in the direction toward the cylinder 6 to be cleaned and presses the cleaning cloth 5 against the cylinder 6. The cleaning cloth 5 can be dampened by means of the spray tube 9.

Once the supply roll 22 has been almost wound off, this is signaled by appropriate means. The connecting element 12, i.e. the connection between the draw-in element 11 and the cleaning cloth 5 is now moved, program-controlled, to the location underneath the pressure element 8, which is accessible to the operator, i.e. into the approximate position represented by the point A in FIG. 1. The connection is severed and the remainder of the cleaning cloth 5 is completely wound onto the receiving roller 4. Thereafter, the used cleaning cloth 5 can be removed from the second cleaning cloth receptacle 3 and disposed of.

Now a fresh supply roller 2' with a supply roll 22' wound on the spindle 21' is inserted into the second cleaning cloth receptacle 3. The beginning of the cleaning cloth 5 of the fresh supply roller 2' with the connecting element, not specifically shown, is connected to the connecting element 12 of the draw-in element 11. Now the cleaning cloth 5 is wound onto the spindle 21 for forming a new fresh supply roll 22 in the first cleaning cloth receptacle 1. In the course of this, the pressure element 8 is moved away from the cylinder 6, i.e. the cleaning cloth 5 has no contact with the surface of the cylinder 6. The winding process takes place at a speed, which is a multiple of the draw-off speed of the cleaning cloth 5 which is customary during the cleaning process.

In the course of winding on the new supply roll 22, the forward movement of the cleaning cloth 5 is detected by the sensor 10, and the data detected in this way are transmitted to a computer, not represented here. Together with machine data (for example the forward movement of the cleaning cloth 5 during the cleaning process) and with the job-specific data, a control of the cleaning process is therefore possible, and [inter alia] also a prediction of the end of the cleaning cloth 5.

The winding-on process is continued until the end of the cleaning cloth 5 has been reached. This end remains fixed in place on the spindle 21'. The cleaning device is therefore ready for operation.

In the course of operating the cleaning device of the type described above, the cleaning cloth 5 is pulled off the now again filled supply roller 2.

Preferred Embodiment 2

The second preferred embodiment is based on a washing device which differs little in structure and function from the one in the first preferred embodiment. FIG. 2 shows a device of this type. Here, the situation prior to the cleaning process is represented, i.e. the washing device is provided with a full supply roller 2.

As can be seen in FIG. 2, in contrast with the first preferred embodiment, a draw-in element 11" is allocated to the spindle 41. It is wound on at the start of the cleaning operation and is then located on the spindle 41 underneath the receiving roll 42 and is not visible in FIG. 2.

When the supply roll 22 on the supply roller 2 is used up, the cleaning cloth fixed in place on the spindle 21 is not separated from the spindle 21. The soiled cleaning cloth 5 is wound back onto the supply roller 2. In the course of this, the pressure element 8 is moved away from the cylinder 6, i.e. the cleaning cloth 5 has no contact with the surface of the cylinder 6. The winding process takes place at a speed which is a multiple of the draw-off speed of the cleaning cloth 5 which is customary during the cleaning process.

The winding process is stopped when the connecting element 12' is in a position above the pressure element 8 which is easily accessible to the operator, as shown in FIG. 2. Thereafter, the soiled cleaning cloth 5 is separated from the draw-in element 11" and the latter is temporarily fixed in place on the frame 7 in a suitable manner. The soiled supply roller 2 can now be removed in one piece from the first cleaning cloth receptacle 1.

Now a fresh supply roller 2 is inserted into the first cleaning cloth receptacle 1. The unused cleaning cloth 5 of the supply roll 2 is connected, via the connecting element 12', to the draw-in element 11' fixed in place on the spindle 41.

The washing device is then ready for operation.

Preferred Embodiment 3

In principle, the configuration of the washing device in accordance with the third preferred embodiment corresponds to the washing devices described in FIGS. 1 and 2. Reference is made to these drawings when describing it.

In the variation in accordance with the third preferred embodiment, a draw-in element, which is not represented in the drawings, is arranged on the spindle 21, and a second draw-in element is arranged on the spindle 41. The cleaning cloth 5 is placed between both draw-in elements, i.e. the cleaning cloth is not directly connected with the spindles 231, 41.

The functioning of this third preferred embodiment is as follows:

If the supply roller 2 is almost empty, this is signalled by suitable means. The connection between the draw-in element on the supply roller 2 and the cleaning cloth 5 is now moved to a position underneath the pressure element 8, which is accessible to the operator. The connection is severed, and the soiled cleaning cloth is manually wound off and is disposed of.

Now the leading end of the fresh cleaning cloth 5 is attached to the draw-in element of the supply roller 2 located on the spindle 21. Here, the unusual feature is that the cleaning cloth 5 to be attached is provided in the required length on an interim roller, not represented, which is placed into an auxiliary device arranged underneath the washing device. This auxiliary device for changing cleaning cloths can be arranged there when needed, or remains there permanently. Now the cleaning cloth 5 is wound from there onto the supply roller 2 in a manner analogous to preferred embodiment 1. Thereafter, the empty spindle or tube of the interim roller is removed out of the auxiliary device and the cleaning cloth trailing end is connected to the draw-in element allocated to the receiving roller 4 and located on the spindle 41. The washing device is thus ready to operate.

This solution has the advantage that neither the spindle 21 nor the spindle 41 need to be removed from the cleaning cloth receptacles 1, 3.

What is claimed is:

1. A washing device for a cylinder of a rotary printing press comprising:

a cleaning cloth having a leading end and a trailing end;

a pressure element adapted to place said cleaning cloth against a surface of a cylinder to be cleaned;

a supply roll of unused portions of said cleaning cloth;

a first spindle supporting said supply roll;

a receiving roll of used portions of said cleaning cloth;

a second spindle supporting said receiving roll;

a flexible draw-in element arranged on at least one of said first and second spindles; and a releasable connection on said flexible, draw-in element, said releasable connection being engageable with said leading end of said cleaning cloth.

2. The washing device of claim 1 wherein said pressure element includes a lower edge spaced from said supply roll at a distance and wherein said flexible draw-in element has a length, said length being at least 1.5 times said distance.

3. The washing device of claim 1 wherein said flexible draw-in element is selected from the group including a tear-resistant plastic, a metal foil, a tear-resistant fabric and a fabric-reinforced rubber band.

4. The washing device of claim 1 wherein said releasable connection is a releasable adhesive connection.

5. The washing device of claim 1 wherein said releasable connection is a hook and loop connection.

* * * * *